US008131175B2

(12) United States Patent
Kim

(10) Patent No.: US 8,131,175 B2
(45) Date of Patent: Mar. 6, 2012

(54) IMAGE FORMING APPARATUS HAVING STRUCTURE TO CLEAN OPTICAL SENSOR AND METHOD OF USING THE SAME

(75) Inventor: Won-taek Kim, Suwon-si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 1005 days.

(21) Appl. No.: 12/041,808

(22) Filed: Mar. 4, 2008

(65) Prior Publication Data

US 2008/0304119 A1 Dec. 11, 2008

(30) Foreign Application Priority Data

Jun. 8, 2007 (KR) ..... 10-2007-0056246

(51) Int. Cl.
*G03G 15/01* (2006.01)
*G03G 15/14* (2006.01)
*G03G 21/00* (2006.01)

(52) U.S. Cl. ..... 399/71; 399/98; 399/302

(58) Field of Classification Search ..... 399/34, 399/71, 74, 98, 99, 301, 302, 308
See application file for complete search history.

(56) References Cited

U.S. PATENT DOCUMENTS

| | | | | |
|---|---|---|---|---|
| 5,729,788 | A * | 3/1998 | Hirohashi et al. | 399/66 |
| 7,020,404 | B2 * | 3/2006 | Fukuda et al. | 399/49 |
| 7,167,661 | B2 * | 1/2007 | Hatakeyama et al. | 399/98 |
| 7,616,909 | B2 * | 11/2009 | Kato et al. | 399/49 |
| 2003/0175041 | A1 * | 9/2003 | Taguchi et al. | 399/66 |
| 2004/0057756 | A1 * | 3/2004 | Taka et al. | 399/301 |

FOREIGN PATENT DOCUMENTS

| | | | |
|---|---|---|---|
| JP | 58158656 | A * | 9/1983 |
| JP | 60143361 | A * | 7/1985 |
| JP | 09006203 | A * | 1/1997 |
| JP | 2004271718 | A * | 9/2004 |
| JP | 2005-134726 | | 5/2005 |
| JP | 2007079321 | A * | 3/2007 |

* cited by examiner

*Primary Examiner* — David Gray
*Assistant Examiner* — Fred L Braun
(74) *Attorney, Agent, or Firm* — Stanzione & Kim, LLP

(57) ABSTRACT

An image forming apparatus has a structure that it is able to clean an ACR sensor in accordance with an ACR operation, and without requiring a user manipulation. The image forming apparatus includes a plurality of photosensitive media on which color images are formed respectively, a transfer unit to receive color images from the plurality of photosensitive media and transfer the received color images onto a printing medium, an auto color registration (ACR) unit to perform the ACR operation with respect to the transferred image, and a cleaning member to clean the ACR unit in association with the ACR operation. A method of cleaning an ACR sensor in an image forming apparatus is also provided.

22 Claims, 4 Drawing Sheets

IMAGE FORMING APPARATUS HAVING STRUCTURE TO CLEAN OPTICAL SENSOR AND METHOD OF USING THE SAME

CROSS-REFERENCE TO RELATED APPLICATIONS

This application claims priority under 35 U.S.C. §119(a) from of Korean Patent Application No. 10-2007-0056246, filed on Jun. 8, 2007, in the Korean Intellectual Property Office, the disclosure of which is hereby incorporated herein in its entirety by reference.

BACKGROUND OF THE INVENTION

1. Field of the Invention

The present general inventive concept relates to an image forming apparatus to print a color image onto a printing medium.

2. Description of the Related Art

An image forming apparatus such as a printer, copier, facsimile or multi-function unit that integrates the above functions has a main function of printing an image onto a printing medium. A color image forming apparatus is also available, which prints images in multiple colors.

A color image forming apparatus generally includes a plurality of photosensitive media to form electrostatic latent images for color printing, a plurality of developing units to develop the electrostatic latent images into developed images in corresponding colors, a transfer unit to receive the developed color images on one another and transfer a composite image onto a printing medium, a fusing unit to fix the transferred image to the printing medium, and a discharge unit to discharge the printing medium outside.

The color image forming apparatus carries out auto color registration (ACR) to align images of each color exactly to intended locations. By the ACR, it is checked whether the color images are correctly printed on the printing medium, and if detected, an abnormality is corrected automatically. Accordingly, an ACR sensor is mounted, facing the transfer unit to sense the color images transferred onto the transfer unit.

The ACR sensor has to be kept clean, in order to perform precise sensing. In a conventional way, a user cleans the ACR sensor using a separate cleaning tool, or operates a separate member such as a sensor cover covering the ACR sensor to wipe contaminants off the ACR sensor.

The ACR sensor is cleaned only when the user notices that the sensor is contaminated. Therefore, the ACR sensor is left contaminated and thus has deterioration of sensing accuracy, if the user does not recognize it. As a result, a color image forming apparatus has a degradation of image quality.

SUMMARY OF THE INVENTION

The present general inventive concept provides an image forming apparatus of an improved structure, to clean an ACR sensor in association with an ACR operation, without requiring a separate manipulation by a user.

Additional aspects and utilities of the present general inventive concept will be set forth in part in the description which follows and, in part, will be obvious from the description, or may be learned by practice of the general inventive concept.

The foregoing and other aspects and utilities of the present general inventive concept may be achieved by providing an image forming apparatus. The image forming apparatus may include a plurality of photosensitive media on which color images are formed respectively, a transfer unit to receive color images from the plurality of photosensitive media and to transfer the received color images onto a printing medium, an auto color registration (ACR) unit to perform an ACR operation with respect to the transferred image, and a cleaning member to clean the ACR unit in association with the ACR operation.

The transfer unit may include a first transfer member to receive images being transferred from the plurality of photosensitive media in an overlapping manner, and a second transfer member contacting the first transfer member, with the printing medium interposed therebetween, to transfer a composite form of the transferred images from the first transfer member onto the printing medium.

The ACR unit may include an ACR sensor to sense the composite image on the first transfer member, a cover member to selectively cover the ACR sensor, a spacer member to selectively space the first and second transfer members from each other, and a movable unit to move the cover member and the spacer member, respectively.

The movable unit may include a movable cam rotatably formed between the cover member and the spacer member, and a driving source to provide the movable cam with a driving force.

The movable cam may be rotatable between a non-ACR position where the cover member covers the ACR sensor and the first and second transfer members contact each other, and an ACR position where the cover member does not cover the ACR sensor and the first and second transfer members are spaced away from each other.

The cover member may include a guide surface to guide the movable cam.

The spacer member may be a lever rotatable about a spacer axis by an interaction with the movable cam, and having the second transfer member supported thereon.

The cover member may be elastically biased by a first elastic member towards the ACR position, and the spacer member may be elastically biased by a second elastic member towards the non-ACR position.

The cleaning member may operate in association with the covering operation of the cover member.

The cleaning member may be an elastic material formed on the cover member.

The first transfer member may be a belt supported by a plurality of support rollers to run, and the second transfer member may be a roller rotating in contact with the belt.

The image forming apparatus may further include a controller to control the movable unit so that the ACR unit starts an ACR operation and the cleaning member starts a cleaning operation concurrently, after a predetermined number of pages of an image transfer is performed.

The foregoing and other aspects and utilities of the present general inventive concept may be achieved by providing an image forming apparatus. The image forming apparatus may include a first, second, third and fourth (first to fourth) photosensitive media on which color images are formed respectively, a transfer unit to receive color images from the first to fourth photosensitive media in an overlapping manner and to transfer a composite form of the received images onto a printing medium, an auto color registration (ACR) unit to perform an ACR operation with respect to the transferred composite image, a cleaning member to clean the ACR unit in association with the ACR operation, and a controller to cause the ACR unit to start the ACR operation and the cleaning member to start the cleaning operation concurrently, after a predetermined number of pages of an image transfer is performed.

The foregoing and/or other aspects and utilities of the general inventive concept may also be achieved by providing an image forming apparatus including an auto color registration (ACR) unit having an ACR sensor to perform an ACR operation, and a cover member to move between a closed state in which the cover member covers the ACR sensor and an open state in which the cover member does not cover the ACR sensor, the cover member having a cleaning member mounted thereto, wherein the cleaning member cleans the ACR sensor when the cover member moves from the closed state to the open state to perform the ACR operation independent of a user manipulation.

The foregoing and/or other aspects and utilities of the general inventive concept may also be achieved by providing a method of cleaning an auto color registration (ACR) sensor in an image forming apparatus, the method including moving a cover member having a cleaning member mounted thereto between a closed state in which the cover member covers the ACR sensor and an open state in which the cover member does not cover the ACR sensor, and cleaning the ACR sensor with the cleaning member when the cover member moves from the closed state to the open state to perform an ACR operation independent of a user manipulation.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
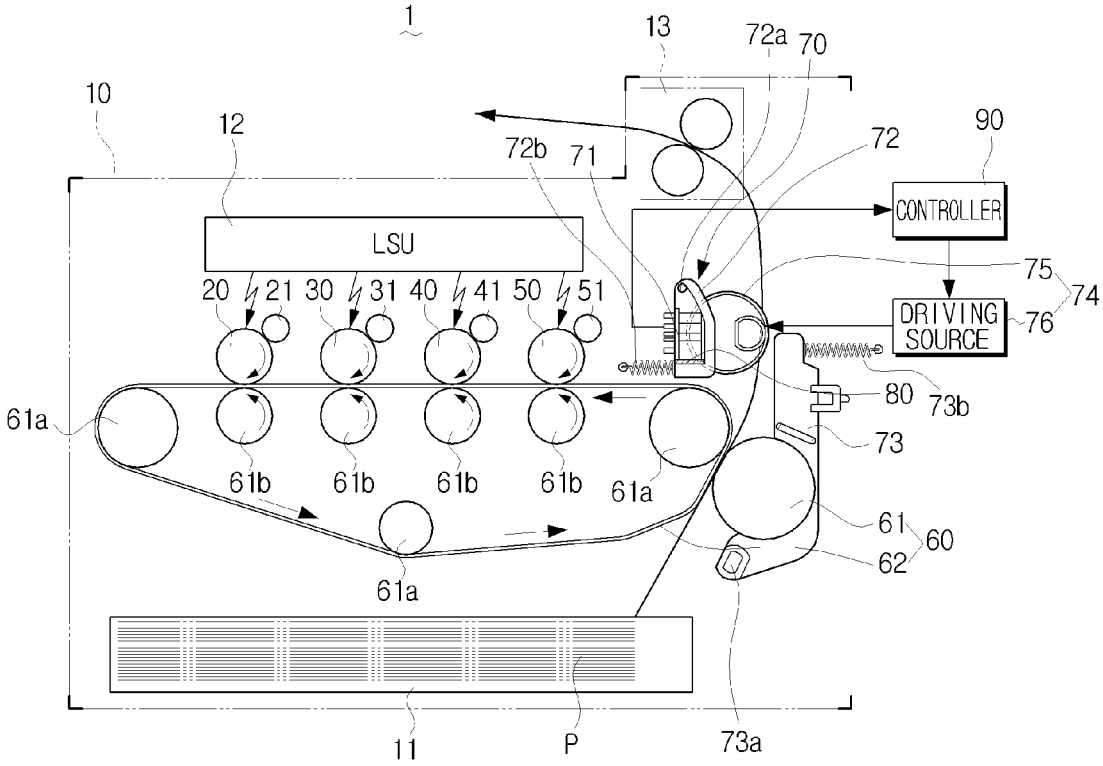
FIG. 1 is a view illustrating an image forming apparatus according to an example embodiment of the present general inventive concept.

Reference will now be made in detail to embodiments of the present general inventive concept, examples of which are illustrated in the accompanying drawings, wherein like reference numerals refer to the like elements throughout. The embodiments are described below in order to explain the present general inventive concept by referring to the figures.

Referring to FIG. 1, an image forming apparatus 1 according to an example embodiment of the present general inventive concept includes a first, second, third and fourth (first to fourth) photosensitive media 20, 30, 40, 50, a transfer unit 60, an auto color registration (ACR) unit 70, a cleaning member 80, and a controller 90.

The first to fourth photosensitive media 20, 30, 40, 50 are arranged in tandem inside a main body 10 of the image forming apparatus 1, to form electrostatic latent images of each color by the light exposure of a light exposure unit 12. When the electrostatic latent images of each color are formed on the first to fourth photosensitive media 20, 30, 40, 50, the images are developed by first to fourth developing rollers 21, 31, 41, 51, respectively.

In the following example, the first to fourth photosensitive media 20, 30, 40, 50 are developed to yellow, magenta, cyan and black images.

Because developing images on the first to fourth photosensitive media 20, 30, 40, 50 into color images is already well known in the art, a detailed explanation and drawing will be omitted for the sake of brevity.

The main body 10 of the image forming apparatus 1 houses therein and protects components to print a color image on a printing medium (P), including, the first to fourth photosensitive media 20, 30, 40, 50, the transfer unit 60, the ACR unit 70, and the cleaning member 80. A feeding cassette 11, storing a stack of printing media (P), is removably mounted in the main body 10, to feed printing media (P) into the main body 10.

The technical structure of the main body 10 of the image forming apparatus 1 is generally known, and therefore, a detailed explanation or drawings thereof will be omitted for the sake of brevity.

The transfer unit 60 receives color images from the first to fourth photosensitive media 20, 30, 40, 50 in an overlapping manner, and transfers a composite image onto the printing medium (P). The transfer unit 60 includes a transfer belt 62, and a transfer roller 61. The color image is transferred by a voltage difference. As this is generally known, a detailed explanation will be omitted for the sake of brevity.

The transfer belt 62 receives color images in an overlapping manner, from the first to fourth photosensitive media 20, 30, 40, 50. As the transfer belt 62 passes through the first to fourth photosensitive media 20, 30, 40, 50, yellow, magenta, cyan and black images are transferred onto the transfer belt 62 consecutively from the first to fourth photosensitive media 20, 30, 40, 50. The transfer belt 62 is movably supported by a plurality of support rollers 61*a*.

Although the embodiment explained above has exemplified the transfer belt 62 as receiving the color images from the first to fourth photosensitive media 20, 30, 40, 50, this will not be construed as limiting. Any unit or member that can receive color images from the first to fourth photosensitive media 20, 30, 40, 50, such as transfer drum or roller, may be implemented.

A plurality of rollers 61*b* are arranged along an inner surface of the transfer belt 62, corresponding with the first to fourth photosensitive media 20, 30, 40, 50 arranged on an outer surface of the transfer belt 62, to help transfer the images from the first to fourth photosensitive media 20, 30, 40, 50.

The transfer roller 61 contacts the transfer belt 62, and contacts the printing medium (P) placed therebetween. Therefore, the transfer roller 61 transfers a composite image of the transfer belt 62 onto the printing medium (P). Transfer of the color image onto the printing medium (P) is completed.

The printing medium (P) bearing the color image passes through the fusing unit 13, where the image is fixed onto the printing medium (P), and is discharged out.

The ACR unit 70 conducts an ACR operation regarding the transferred image. The ACR operation includes determining whether the color images are printed onto the printing medium P in alignment with each other, and if a determination is made that it is not in alignment with each other, an alignment of the images is corrected automatically. The ACR unit 70 includes an ACR sensor 71, a cover member 72, a spacer member 73, and a movable unit 74.

The ACR sensor 71 senses the image transferred onto the transfer belt 62. The ACR sensor 71 is mounted in the main body 10, facing the transfer belt 62, to sense a final form of the composite color image on the transfer belt 62.

The ACR sensor 71 is arranged behind the first to fourth photosensitive media 20, 30, 40, 50, in an advancing direction of the transfer belt 62. The image is not transferred onto the printing medium (P) during the ACR operation, that is, while the ACR sensor 71 performs a sensing operation.

Although not illustrated, two or more ACR sensors 71 can be arranged opposite to each other in a width direction, to detect the composite image on the transfer belt 62 accurately.

The ACR sensor 71 may be implemented as an optical sensor having a high detection ability, such as a photo transistor, photo diode, or the like, to detect the alignment of the images with accuracy. Because use of the optical sensor is generally known, a detailed explanation or drawings thereof will be omitted for the sake of brevity.

Figure 2:
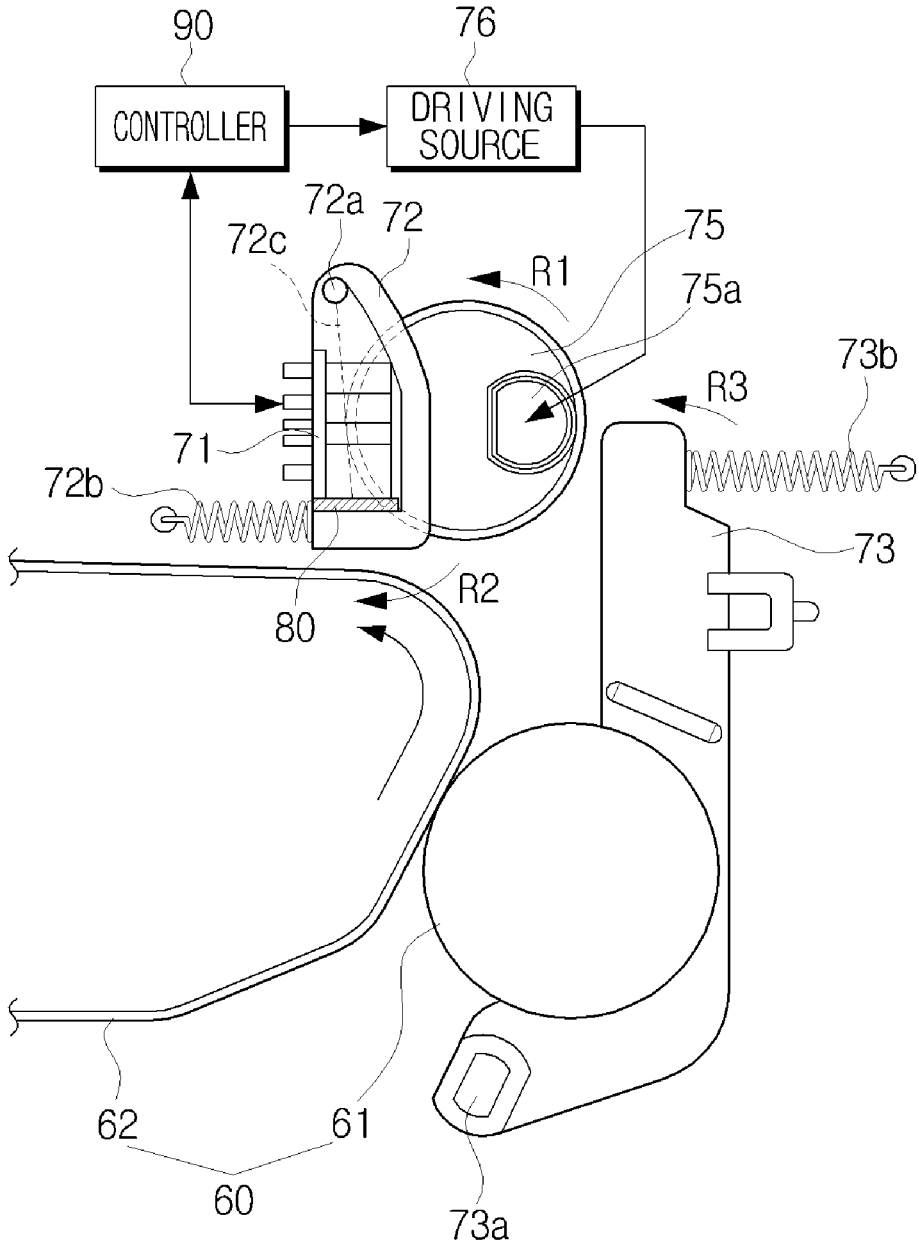
FIG. 2 is a cross section view illustrating an auto color registration (ACR) unit and a cleaning member in a non-ACR position.
Figure 3:
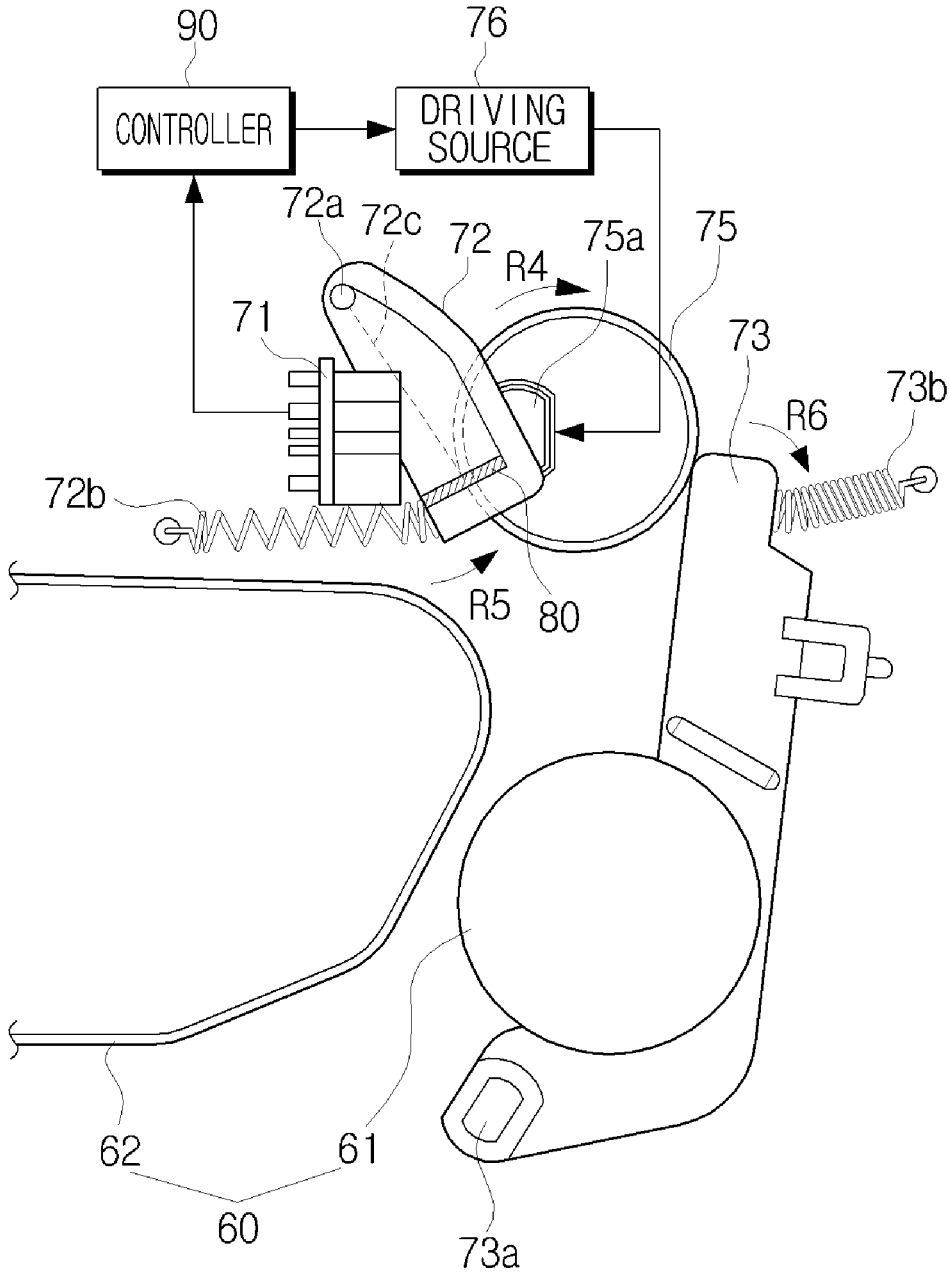
FIG. 3 is a cross section view illustrating an ACR unit and a cleaning member in an ACR position.

Referring to FIGS. 2 and 3, the cover member 72 is rotatable about a cover axis 72*a*, to selectively cover the ACR sensor 71. The cover member 72 is rotatable between a cover position to cover the ACR sensor 71 in a non-ACR operation, and an open position to open the ACR sensor to start the ACR operation.

The cover member 72 is elastically supported by a first elastic member 72*b*. The elastic member 72*b* may be implemented as a compression coil spring, whose one end is supported on the main body 10 of the image forming apparatus 1, and an other end supports the cover member 72. The elastic member 72*b* elastically biases the cover member 72 towards the ACR sensor closed position.

Although the present embodiment implemented a compression coil spring as the first elastic member 72*b* to support the cover member 72, this should not be construed as limiting. Any elastic unit or member such as a torsion spring, that is capable of elastically urging the cover member 72 to the ACR sensor 71, can be used as the first elastic member 72*b*.

The spacer member 73 selectively distances the transfer belt 62 away from the transfer roller 61 to perform the ACR operation. The spacer member 73 may be implemented as a lever, rotating about a spacer axis 73*a*, while supporting the transfer roller 61.

The spacer member 73 is elastically urged by the second elastic member 73*b* towards the position where the transfer belt 62 contacts the transfer roller 61. Referring to FIGS. 2 and 3, the second elastic member 73*b* may be implemented as a compression coil spring whose one end is supported on the main body 10 of the image forming apparatus 1, while an other end is supported on the spacer member 73. The second elastic member 73*b* biases the spacer member 73 to return towards an original position, to cause the transfer roller 61 to move from a position distanced away from the transfer belt 62 to a position contacting the transfer belt 62 (FIG. 2).

The second elastic member 73*b* may be a compression coil spring, like the first elastic member 72*b*. However, one skilled in the art will appreciate that any other elastic unit or member such as torsion spring can be used as the second elastic member 73*b* without departing from the scope of the general inventive concept.

The movable unit 74 moves the cover member 72 and the spacer member 73. The movable unit 74 includes a movable cam 75 and a driving source 76.

The movable cam 75 is disposed between the cover member 72 and the spacer member 73, to rotate about a movable axis 75*a*. The movable axis 75*a* is eccentrically formed with respect to the movable cam 75.

The movable cam 75 is rotated between a non-ACR position where the cover member 72 covers the ACR sensor 71 and the transfer roller 61 contacts the transfer belt 62 to carry out a transfer operation, and an ACR position where the ACR sensor 71 is not covered by the cover member 72 and can perform an ACR operation and the transfer roller 61 is spaced apart from the transfer belt 62.

According to movement of the movable cam 75 towards the non-ACR position, as illustrated in FIG. 2, the cover member 72 moves to the cover position, and the spacer member 73 is positioned at a contact position. Then according to the movement of the movable cam 75 towards the ACR position, as illustrated in FIG. 3, the cover member 72 moves to the open position, and the spacer member 73 moves to the spacing position. That is, the movable cam 75 moving towards the non-ACR position, the cover member 72 moving towards the cover position, and the spacer member 73 moving towards the contact position, happen concurrently. Likewise, the movable cam 75 moving towards the ACR position, the cover member 72 moving towards the open position, and the spacer member 73 moving towards the spacing position, also happen concurrently.

A guide surface 72*c* is formed on the cover member 72, to guide a covering operation of the cover member 72 according to the movable cam 75. The cover member 72 has a space formed therein to selectively receive the ACR sensor 71, and the guide surface 72*c* formed on an outer surface thereof to contact the movable cam 75.

Referring to FIGS. 2 and 3, the driving source 76 provides a driving force so that the movable cam 75 can be driven in different directions (R1, R4). The controller 90, which will be explained below, controls the driving directions of the driving source 76.

The cleaning member 80 cleans the ACR sensor 71 of the ACR unit 70, in association with the ACR operation of the ACR unit 70. The cleaning member 80 is formed on an inner side of the cover member 72 to be moved in association with a rotational movement of the cover member 72. The cleaning member 80 may be implemented as an elastic material such as a sponge.

The cleaning member 80 may be attached to the inner side of the cover member 72, to clean the sensing surface of the ACR sensor 71 that faces the transfer belt 62. When the covering member 72 is in the cover position, that is, when the covering member 72 is in the non-ACR position to cover the ACR sensor 71, the cleaning member 80 contacts the sensing surface of the ACR sensor 71 to protect the ACR sensor 71 from external contaminants.

When the cover member 72 is in an open position, that is, when the cover member 72 is in the ACR position so that the cover member 72 does not cover the ACR sensor 71 so that the ACR sensor can perform the ACR operation, the cleaning member 80 wipes contaminants off the sensing surface of the ACR sensor 71 in association with an opening of the cover member 72.

As the cover member 72 returns to the non-ACR position (cover position) upon completing the ACR operation, the cleaning member 80 again wipes off the sensing surface of the ACR sensor 71.

The controller 90 controls the components of the image forming apparatus 1 throughout the printing process. In the present embodiment, the controller 90 particularly controls the ACR operation of the ACR unit 70, and the cleaning operation of the cleaning member 80.

More particularly, the controller 90 controls the driving direction of the driving source 76 for the ACR operation to start with the printing operation, or to start after the printing media (P) on which the color images are transferred exceeds a predetermined number of counts, such as 200 sheets.

As the movable cam 75 rotates in an R4 direction (FIG. 3), the cover member 72 rotates in R5 direction, thereby not obstructing the ACR sensor 71 and also concurrently rotating the spacer member 73 in an R6 direction to the ACR position where the transfer belt 62 and the transfer roller 61 are spaced away from each other.

The driving source 76, under control of the controller 90, rotates the movable cam 75 in the direction R1 in the transfer operation, so that the cover member 72 and the spacer member 73 are rotated about the cover axis 72*a* and the spacer axis 73*a* in R2 and R3 directions, respectively, and stop at the non-ACR position.

The cleaning member 80 cleans the ACR sensor 71 in accordance with the rotation of the cover member 72 in R2 and R5 directions.

The controller 90 is connected with the ACR sensor 71 to provide a signal exchange, and therefore, is capable of determining whether color images are in alignment with each other from the signal received from the ACR sensor 71. On detecting a signal corresponding to misalignment of the color images, the controller 90 starts a compensation process to align the images.

The operation of the image forming apparatus constructed as explained above according to the present embodiment will be explained below with reference to FIGS. 1 to 3.

Referring to FIGS. 1 and 2, electrostatic latent images on the first to fourth photosensitive media 20, 30, 40, 50 are developed to yellow, magenta, cyan and black images by the first to fourth developing rollers 21, 31, 41, 51, respectively. The developed color images are then contacted with the first to fourth photosensitive media 20, 30, 40, 50, and transferred onto the transfer belt 62 in an overlapping manner.

Referring to FIG. 2, as the movable cam 75 is moved in the R1 direction, the cover member 72 and the spacer member 73 are moved to the non-ACR position. Accordingly, the cover member 72 covers the ACR sensor 71, and the transfer belt 62 and the transfer roller 61 contact each other. The cleaning member 80 of the cover member 72 screens the sensing surface of the ACR sensor 71, thereby protecting the ACR sensor 71 from external contaminants.

The composite image is transferred from the transfer belt 62 onto a printing medium (P) passing in between the transfer belt 62 and the transfer roller 61, and fixed to the printing medium (P) by the fusing unit 13. The printing medium (P) with the fixed color image is then discharged out of the main body 10 of the image forming apparatus 1.

Meanwhile, the controller 90 may control the ACR unit 70 to start the ACR operation when a predetermined number of pages are printed. Accordingly, as illustrated in FIG. 3, the driving source 76 causes the movable cam 75 to rotate about the movable axis 75*a* in the R4 direction. The movable cam 75 is guided along the guide surface 72*c* formed on the outer side of the cover member 72, and the cover member 72 is elastically biased towards the ACR position by the first elastic member 72*b*. As a result, the cover member 72 rotates in the R5 direction, and stops at the ACR position (open position).

The movable cam 75 rotating in the R4 direction interferes with the spacer member 73, and thus causes the spacer member 73 to rotate about the spacer axis 73*a* in the R6 direction. As a result, the second elastic member 73*b* is compressed against the spacer member 73, and the transfer roller 61, being supported by the spacer member 73, is spaced away from the transfer belt 62.

Accordingly, the sensing surface of the ACR sensor 71 is open, to sense the composite image formed on the transfer belt 62. The cleaning member 80, which is brought in contact with the ACR sensor 71 by the rotation of the cover member 72 in the R5 direction, rotates along with the cover member 72, to wipe off the sensing surface of the ACR sensor 71.

The information based on the sensing of the composite color image by the ACR sensor 71 is transmitted to the controller 90, and the controller 90 determines whether color images are in alignment with each other based on the received information. If an abnormality in the image alignment is detected, the controller 90 causes a compensation process to start.

If no abnormality in the image alignment is detected, the controller 90 resumes the printing operation. Accordingly, the controller 90 causes the driving direction of the driving source 76 to change to the R1 direction as illustrated in FIG. 2, so that the cover member 72 and the spacer member 73 rotate in the R2 and R3 directions, respectively, and stop at the non-ACR position. At this time, the cleaning member 80 wipes off the sensing surface of the ACR sensor 71 once again in accordance with the rotation of the cover member 72, before the ACR sensor 71 is covered.

In the non-limiting examples set forth above, the ACR operation starts after a predetermined number of pages are printed. However, one skilled in the art will appreciate that other variations and modifications are possible. By way of a few examples of such modifications, the ACR operation may start before the initial printing process, or start regularly after each printing operation.

Figure 4:
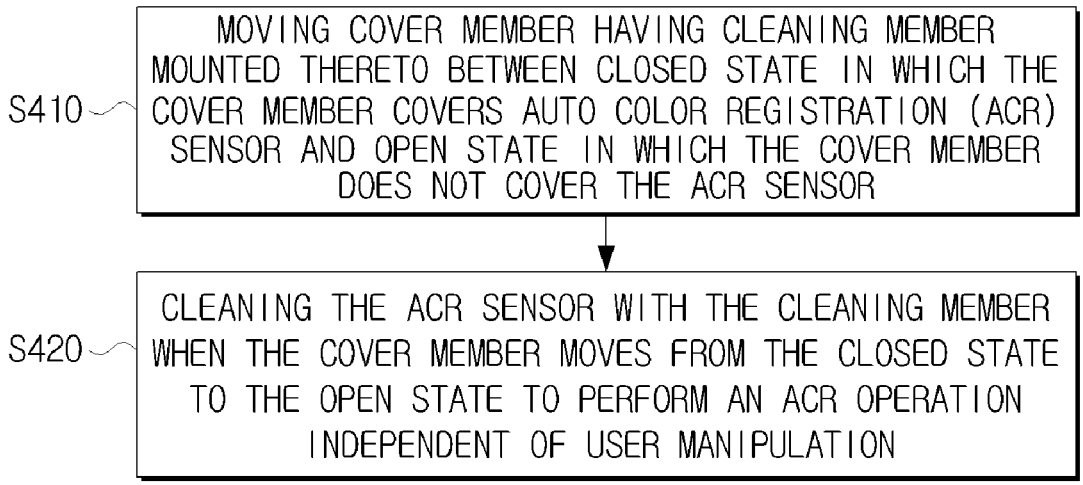
FIG. 4 is a flowchart illustrating a method of cleaning an auto color registration (ACR) sensor in an image forming apparatus according to an embodiment of the present general inventive concept.

FIG. 4 is a flowchart illustrating a method of cleaning an auto color registration (ACR) sensor in an image forming apparatus according to an embodiment of the present general inventive concept. Referring to FIG. 4, in operation 410, a cover member having a cleaning member mounted thereto is moved between a closed state in which the cover member covers the ACR sensor and an open state in which the cover member does not cover the ACR sensor. In operation 420, the ACR sensor is cleaned with the cleaning member when the cover member moves from the closed state to the open state to perform an ACR operation independent of a user manipulation.

The present general inventive concept can also be embodied as computer-readable codes on a computer-readable medium. The computer-readable medium can include a computer-readable recording medium and a computer-readable transmission medium. The computer-readable recording medium is any data storage device that can store data that can be thereafter read by a computer system. Examples of the computer-readable recording medium include read-only memory (ROM), random-access memory (RAM), CD-ROMs, magnetic tapes, floppy disks, and optical data storage devices. The computer-readable recording medium can also be distributed over network coupled computer systems so that the computer-readable code is stored and executed in a distributed fashion. The computer-readable transmission medium can transmit carrier waves or signals (e.g., wired or wireless data transmission through the Internet). Also, functional programs, codes, and code segments to accomplish the present general inventive concept can be easily construed by programmers skilled in the art to which the present general inventive concept pertains.

As explained above, according to various embodiments of present general inventive concept, both the cover member 72 to cover the ACR sensor 71 and having the cleaning member 80 therein, and the spacer member 73 to support the transfer roller 61, can be moved concurrently to the non-ACR position or to the ACR position, by covering the ACR sensor 71 according to a direction of the movable unit 74. As a result, the ACR sensor is cleaned and the transfer roller 61 is spaced apart from the transfer belt 62, in association with the ACR operation, and without requiring a separate manipulation by a user.

Because the ACR sensor 71 cleaning and ACR operation are performed concurrently and require a simple structure, a more economical and compact image forming apparatus is provided. Furthermore, because the ACR sensor 71 is cleaned every time the ACR operation is done, efficiency of the ACR operation increases.

Although various embodiments of the present general inventive concept have been illustrated and described, it will be appreciated by those skilled in the art that changes may be made in these embodiments without departing from the principles and spirit of the general inventive concept, the scope of which is defined in the appended claims and their equivalents.

What is claimed is:

1. An image forming apparatus, comprising:

an auto color registration (ACR) unit having an ACR sensor to perform an ACR operation;

a movable unit adjacent the ACR sensor to be moved upon performance of the ACR operation;

a cover member to move between a closed state in which the cover member covers the ACR sensor and an open state in which the cover member is moved by the movable unit and does not cover the ACR sensor, the cover member having a cleaning member mounted thereto; and a spacer member adjacent the movable unit to be moved by the movable unit when the cover member moves between the closed state and the open state;

wherein the cleaning member cleans the ACR sensor when the cover member moves from the closed state to the open state to perform the ACR operation independent of a user manipulation.

2. An image forming apparatus, comprising:

a plurality of photosensitive media on which color images are formed respectively;

a transfer unit to receive color images from the plurality of photosensitive media and to transfer the received color images onto a printing medium;

an auto color registration (ACR) unit to perform an ACR operation onto the transferred image; and a cleaning member to clean the ACR unit in association with the ACR operation, wherein the ACR unit comprises:

an ACR sensor to perform the ACR operation;

a movable unit adjacent the ACR sensor to be moved upon performance of the ACR operation;

a cover member to move between a closed state in which the cover member covers the ACR sensor and an open state in which the cover member is moved by the movable unit and does not cover the ACR sensor, the cover member having the cleaning member mounted thereto; and a spacer member adjacent the movable unit to be moved by the movable unit when the cover member moves between the closed state and the open state.

3. The image forming apparatus of claim 2, wherein the transfer unit comprises:

a first transfer member to receive images being transferred from the plurality of photosensitive media in an overlapping manner; and a second transfer member contacting the first transfer member, with the printing medium interposed therebetween, to transfer a composite form of the transferred images from the first transfer member onto the printing medium.

4. The image forming apparatus of claim 3, wherein:

the first transfer member comprises:

a belt supported by a plurality of support rollers to run; and the second transfer member comprises:

a roller rotating in contact with the belt.

5. The image forming apparatus of claim 3, wherein the ACR sensor senses the images transferred onto the first transfer member and the spacer member selectively spaces the first and second transfer members from each other.

6. The image forming apparatus of claim 5, wherein the cleaning member operates in association with a covering operation of the cover member.

7. The image forming apparatus of claim 6, wherein the cleaning member comprises:

an elastic material formed on the cover member.

8. The image forming apparatus of claim 6, wherein the movable unit comprises:

a movable cam rotatably formed between the cover member and the spacer member; and a driving source to provide the movable cam with a driving force.

9. The image forming apparatus of claim 8, wherein the movable cam is rotatable between a non-ACR position where the cover member covers the ACR sensor and the first and second transfer members contact each other, and an ACR position where the cover member does not cover the ACR sensor and the first and second transfer members are spaced away from each other.

10. The image forming apparatus of claim 9, wherein the cover member comprises:

a guide surface to guide the movable cam.

11. The image forming apparatus of claim 9, wherein the spacer member comprises:

a lever rotatable about a spacer axis by an interaction with the movable cam, and having the second transfer member supported thereon.

12. The image forming apparatus of claim 11, wherein the cover member is elastically biased by a first elastic member towards the ACR position, and the spacer member is elastically biased by a second elastic member towards the non-ACR position.

13. The image forming apparatus of claim 1, further comprising a controller to control the movable unit so that the ACR unit starts the ACR operation and the cleaning member starts a cleaning operation concurrently, after a predetermined number of pages of an image transfer is performed.

14. An image forming apparatus, comprising:

a first, second, third and fourth (first to fourth) photosensitive media on which color images are formed respectively;

a transfer unit to receive color images from the first to fourth photosensitive media in an overlapping manner and to transfer a composite form of the received images onto a printing medium;

an auto color registration (ACR) unit to perform an ACR operation onto the transferred composite image;

a cleaning member to clean the ACR unit in association with the ACR operation; and a controller to cause the ACR unit to start the ACR operation and the cleaning member to start the cleaning operation concurrently, after a predetermined number of pages of an image transfer is performed, wherein the ACR unit comprises:

an ACR sensor to perform the ACR operation:

a movable unit adjacent the ACR unit to be moved upon performance of the ACR operation;

a cover member to move between a closed state in which the cover member covers the ACR sensor and an open state in which the cover member is moved by the movable unit and does not cover the ACR sensor, the cover member having the cleaning member mounted thereto; and a spacer member adjacent the movable unit to be moved by the movable unit when the cover member moves between the closed state and the open state.

15. The image forming apparatus of claim 14, wherein the transfer unit comprises:

a transfer belt on which images of the first to fourth photosensitive media are transferred in an overlapping manner; and a transfer roller contacting the transfer belt, and having the printing medium interposed therebetween, to transfer a composite form of transferred images from the transfer belt onto the printing medium.

16. The image forming apparatus of claim 15, wherein the ACR sensor senses the images transferred onto the transfer belt, the spacer member selectively spaces the transfer belt and the transfer roller from each other, and the movable unit is controlled by the controller, to move the cover member and the spacer member, respectively.

17. The image forming apparatus of claim 16, wherein the cleaning member operates in association with a covering operation of the cover member.

18. The image forming apparatus of claim 17, wherein the movable unit comprises:

a movable cam rotatably formed between the cover member and the spacer member; and a driving source, controlled by the controller, to provide the movable cam with driving forces in different directions.

19. The image forming apparatus of claim 18, wherein the movable cam is rotatable between a non-ACR position where the cover member covers the ACR sensor and the transfer belt and the transfer roller contact each other, and an ACR position where the cover member does not cover the ACR sensor, and the transfer belt and the transfer roller are spaced away from each other.

20. An image forming apparatus, comprising:

a plurality of photosensitive media on which color images are formed respectively;

a transfer unit to receive color images from the plurality of photosensitive media and to transfer the received color images onto a printing medium, the transfer unit comprising:

a first transfer member to receive images being transferred from the plurality of photosensitive media in an overlapping manner; and a second transfer member contacting the first transfer member, with the printing medium interposed therebetween, to transfer a composite form of the transferred images from the first transfer member onto the printing medium;

an auto color registration (ACR) unit to perform an ACR operation with respect to the transferred image, the ACR unit comprising:

an ACR sensor to sense the composite image on the first transfer member;

a cover member to selectively cover the ACR sensor;

a spacer member to selectively space the first and second transfer members from each other; and a movable unit to move the cover member and the spacer member, respectively, the movable unit comprising:

a movable cam rotatably formed between the cover member and the spacer member; and a driving source to provide the movable cam with a driving force, wherein the movable cam is rotatable between a non-ACR position where the cover member covers the ACR sensor and the first and second transfer members contact each other, and an ACR position where the cover member does not cover the ACR sensor and the first and second transfer members are spaced away from each other; and a cleaning member to clean the ACR unit in association with the ACR operation and operate in association with a covering operation of the cover member, wherein the cover member comprises a guide surface to guide the movable cam.

21. An image forming apparatus, comprising:

a plurality of photosensitive media on which color images are formed respectively;

a transfer unit to receive color images from the plurality of photosensitive media and to transfer the received color images onto a printing medium, the transfer unit comprising:

a first transfer member to receive images being transferred from the plurality of photosensitive media in an overlapping manner; and a second transfer member contacting the first transfer member, with the printing medium interposed therebetween, to transfer a composite form of the transferred images from the first transfer member onto the printing medium;

an auto color registration (ACR) unit to perform an ACR operation with respect to the transferred image, the ACR unit comprising:

an ACR sensor to sense the composite image on the first transfer member;

a cover member to selectively cover the ACR sensor;

a spacer member to selectively space the first and second transfer members from each other; and a movable unit to move the cover member and the spacer member, respectively, the movable unit comprising:

a movable cam rotatably formed between the cover member and the spacer member; and a driving source to provide the movable cam with a driving force, wherein the movable cam is rotatable between a non-ACR position where the cover member covers the ACR sensor and the first and second transfer members contact each other, and an ACR position where the cover member does not cover the ACR sensor and the first and second transfer members are spaced away from each other; and a cleaning member to clean the ACR unit in association with the ACR operation and operate in association with a covering operation of the cover member, wherein the spacer member comprises a lever rotatable about a spacer axis by an interaction with the movable cam, and having the second transfer member supported thereon.

22. A method of cleaning an auto color registration (ACR) sensor in an image forming apparatus, the method comprising:

moving a cover member having a cleaning member mounted thereto between a closed state in which the cover member covers the ACR sensor and an open state in which the cover member is moved by a movable unit adjacent the ACR unit upon performance of an ACR operation and does not cover the ACR sensor;

moving a spacer member adjacent the movable unit when the cover member moves between the closed state and an open state; and cleaning the ACR sensor with the cleaning member when the cover member moves from the closed state to the open state to perform an ACR operation independent of a user manipulation.

* * * * *